US006669115B2

(12) United States Patent
Sun et al.

(10) Patent No.: US 6,669,115 B2
(45) Date of Patent: Dec. 30, 2003

(54) VORTEX TWIN-FLUID NOZZLE WITH SELF-CLEANING PINTLE

(76) Inventors: Tai-Yen Sun, 4603 McFarland Rd., South Euclid, OH (US) 44121; Shu-Hsien Wei, 4603 McFarland Rd., South Euclid, OH (US) 44121

( * ) Notice: Subject to any disclaimer, the term of this patent is extended or adjusted under 35 U.S.C. 154(b) by 17 days.

(21) Appl. No.: 10/072,027

(22) Filed: Feb. 7, 2002

(65) Prior Publication Data

US 2003/0146301 A1 Aug. 7, 2003

(51) Int. Cl.[7] ..... B05B 7/10

(52) U.S. Cl. ..... 239/403; 239/419.3; 239/423; 239/468; 239/470; 239/482

(58) Field of Search ..... 239/399, 403, 239/405, 406, 419, 419.3, 422, 423, 429, 432, 470, 463, 468, 469, 474, 475, 478, 482, 483, 491, 492, 493, 497

(56) References Cited

U.S. PATENT DOCUMENTS

| | | | | | |
|---|---|---|---|---|---|
| 2,044,720 | A | * | 6/1936 | Fletcher | 239/399 |
| 2,854,285 | A | * | 9/1958 | Barton | 239/399 |
| 3,078,047 | A | * | 2/1963 | Enemark | 239/430 |
| 3,130,914 | A | * | 4/1964 | Carkin et al. | 239/433 |
| 3,198,258 | A | * | 8/1965 | Werner | 169/37 |
| 3,485,451 | A | * | 12/1969 | Gore et al. | 239/383 |
| 3,693,886 | A | | 9/1972 | Conrad | |
| 3,747,851 | A | | 7/1973 | Conrad | |
| 3,885,918 | A | * | 5/1975 | Isahaya | 422/168 |
| 5,050,799 | A | * | 9/1991 | Rohs | 239/124 |
| 5,320,290 | A | * | 6/1994 | Rohs et al. | 239/124 |
| 5,553,784 | A | | 9/1996 | Theurer | |
| 6,142,388 | A | | 11/2000 | Schwab | |

* cited by examiner

*Primary Examiner*—Christopher Kim

(57) ABSTRACT

A nozzle for discharging finely atomized fluids comprises a vortex-mixing-module with a mixing chamber along with at least one liquid inlet tangentially communicating with the chamber and at least one gas inlet axially communicating with the liquid inlet prior to their injection into the mixing chamber, wherein the mixed fluid of liquid/gas from the liquid inlet is setting vortex flow, re-mixing with each other and forming bubble-laden fluid. An impingement member positioned at the downstream of a substantially concentric-mounted pintle stem of the module provides the function of metering flow and forming the spray angle while maintaining the flow distribution to be axial-symmetric in both mass and velocity plus forming a flow field with non-disturbed angular momentum. A gas passage prepared in the pintle stem and exiting to the downstream side of the deflector provides the feature of cleaning the pintle surface, which eliminates the coarse drops on the pintle surface, stops any undesired residual hard layer from accumulation, and provides surface cooling for required high temperature applications.

17 Claims, 4 Drawing Sheets

SECTION A-A

VORTEX TWIN-FLUID NOZZLE WITH SELF-CLEANING PINTLE

FIELD OF INVENTION

The present invention relates to atomizing nozzles and, more particularly, to twin-fluid atomizers comprising features of double-dipped fuel/gas mixing and pintle self-cleaning for creating sprays with extremely fine drops.

BACKGROUND OF THE INVENTION

Liquid atomization is one of the most effective methods in preparing liquid with maximized total surface area for various industrial applications, such as agricultural spraying, evaporation cooling, slurry drying, scrubbing of stack gases, dust collectors and oil-burner combustion processes. There are two kinds of atomizing schemes being used in nozzle design: pressure atomizers (single-fluid) and twin-fluid atomizers. The pressure atomizer, single-fluid, achieves droplet atomization by transforming pressure energy of the liquid to form high velocity liquid jet/film as it is injecting out of the atomizer. The exiting high velocity-jet/film is further sheared into small drops by the ambient airfield that contains induced-turbulent energy adjacent to the atomizer exit. This atomizer is widely used in low flow rate applications. In high flow rate requirements, however, the high velocity jet/film from a pressure atomizer becomes much thicker, which makes it harder to be atomized by the ambient air only. A remedy is to use a twin-fluid nozzle, which introduces pressurized gas to mix with the liquid prior to its injection, thus improving atomization at higher flow rate conditions. While in its operation, in the microscopic view point, gas is introduced under pressure to stir and mix with the liquid in the nozzle chamber to generate numerous tiny bubbles of gas entrapped into the liquid, which causes the viscosity and surface tension of the liquid to be much reduced (bubble-laden fluid) and results in much finer sprays. Technically, there are two atomization mechanisms involved in this liquid break-up process. The primary atomization is achieved at the nozzle exiting port by the sudden expansion of those entrapped-bubbles in the liquid as they experience pressure reduction, thus forming a fast moving dense spray of fine drops. The secondary atomization is subsequently introduced by the turbulent shear force from ambient air that breaks the high velocity moving drops into even finer sprays. The latter process shares the same spirit of the atomization mechanism with the pressure atomizer as described above. In general, the twin-fluid nozzle has broader usage in industrial applications in light of its much higher flow rate capacity and its much finer drops generated over a fairly wide operating range (also called turndown ratio).

On the twin-fluid nozzle, a fairly effective design of the prior art is shown in FIG. 8. This nozzle utilizes a nozzle cap 1000 to assist in the production of liquid drops. In FIG. 8, the nozzle cap 1000 includes an outer frame 1005, a pintle 1010 and support spokes 1015 to support and couple the pintle 1010 to the outer frame 1005. The pintle comprises an inlet splash plate 1020, a tapered shaft 1025 and an outlet deflector plate 1040 (FIG. 9). The function of the prior art is to make a liquid stream injecting on the splash plate 1020 perpendicularly to form liquid films on both surfaces of plate 1020 and spokes 1015. The swirling atomization air introduced from the upstream of the splash plate (not shown) is then mixed with the liquid films in the passage between the spokes as well as the downstream annular passage defined by the outer surface of the pintle 1025 and the inner surface 1035 of the frame 1005. Another example of prior art is shown in FIG. 10. This design modifies the prior art of FIG. 8 by positioning dams 1051 on spokes 1052 to improve the nozzle performance by reducing the amount of liquid flowing on the spokes while the liquid and air is mixing in the nozzle.

These designs are fairly effective in achieving gas/liquid mixing and atomization, nonetheless, subject to several limitations.

1. When the nozzle is used for injecting liquid with abrasive particles or contamination, erosion on the spokes 1015 or 1052 can occur, resulting in the damage of the pintle leading to failure of the nozzle.

2. As the swirling air being introduced into the mixing chamber of the nozzle (not shown) mixes with the liquid on the surface of both the splash plate 1020 and the spokes 1015, several aerodynamic wakes could be generated at the downstream of these spokes. In the wake region of the nozzle chamber (downstream of the spokes 1015), both velocity and angular momentum of the mixed fluid are significantly reduced in quantity and their distributions could become non-axial-symmetrically skewed. The skewed flow pattern then propagates through the nozzle exit and results in non-uniform sprays. This outcome can severely compromise the nozzle performance in several widely used applications, for instance, in furnaces of industrial oil burners, given the fact that the uniformity of a spray as well as its well maintained angular momentum are vital factors to stable flames in the burner.

3. As a spray is formulated after impinging on the deflect plate 1040, an axially symmetric recirculation region with lower pressure will also be formed in the center of the spray adjacent to the surface 1040 of deflector 1039. In this low-pressure recirculation zone, fine drops in the spray will be sucked back toward the downstream surface of the deflector and form large drops on the surface, called re-attachment. This process will compromise the spray quality quite severely in some cases. For example, in the applications of oil burner combustion or slurry heating processes, as the radiation heat in the furnace raises the surface temperature of the deflector, some recirculating fine drops in the spray accumulated on the downstream surface 1040 of the deflector can form layers of dried shells/cokings. Over time, the hardened slurry build-up, or coking layer in the oil burner cases, on top of the deflector edge can round and dull the sharp edge and cause the spray angle to be reduced, leading to more coarse drops in the spray. Nozzles under this limitation can compromise the quality of the powder-production in the slurry drying processes. Or it could severely damage the liner of a burner and cause unstable flames. The built-up coking layer on the pintle surface in the oil-burner will further cause hot spots on the pintle surface itself and eventually damage the pintle and cause the nozzle to fail.

SUMMARY OF THE INVENTION

This design comprises a vortex-mixing-module containing two new features. First, liquid and gas streams are pre-mixed by injecting both into the same swirler slots prior to their entering the annular mixing chamber of the module. Second, a pintle is center-mounted, and is provided with a self-cleaning feature. With this double-dipped mixing arrangement, the effectiveness of mixing between liquid/gas is much enhanced and the size of the mixing module can be greatly reduced, in comparison to the prior art, to result in more uniform fine sprays of great turndown ratio. The center-mounted pintle concept totally eliminates the possibility of pintle damage caused by the spoke erosion as shown in the prior arts (FIGS. 8 & 10) and provides a non-disturbed annular mixing chamber for generating well-mixed fluid with high angular momentum. The self-cleaning feature on the pintle serves to improve spray quality and increase the life span of the nozzle service, and is especially beneficial to a burner application where cooling of the hot surface of the deflector is needed. In more detail, the self-cleaning feature of the pintle is achieved with a center-drilled hole along the stem of the pintle to the downstream of the deflector plate, where a purge-disk is mounted substantially concentrically to the deflector downstream surface. This forms a passage which can tap part of the atomizing gas from the pressure source and turn it out to become purge gas to the downstream surface of the deflector plate. As the purge gas is exiting out of the slit on the deflector with extremely high velocity, it cleans the surface and prevents recirculated drops from forming the undesired hard-shell-accumulation on the surface that damages the pintle or compromises the nozzle performance.

BRIEF DESCRIPTION OF THE DRAWINGS

FIG. 5 is a front view of a preferred embodiment of dual-fluid nozzle showing the cross-section line that the view of FIG. 4 is taken from.

DESCRIPTION OF THE PREFERRED EMBODIMENTS

Figure 1:
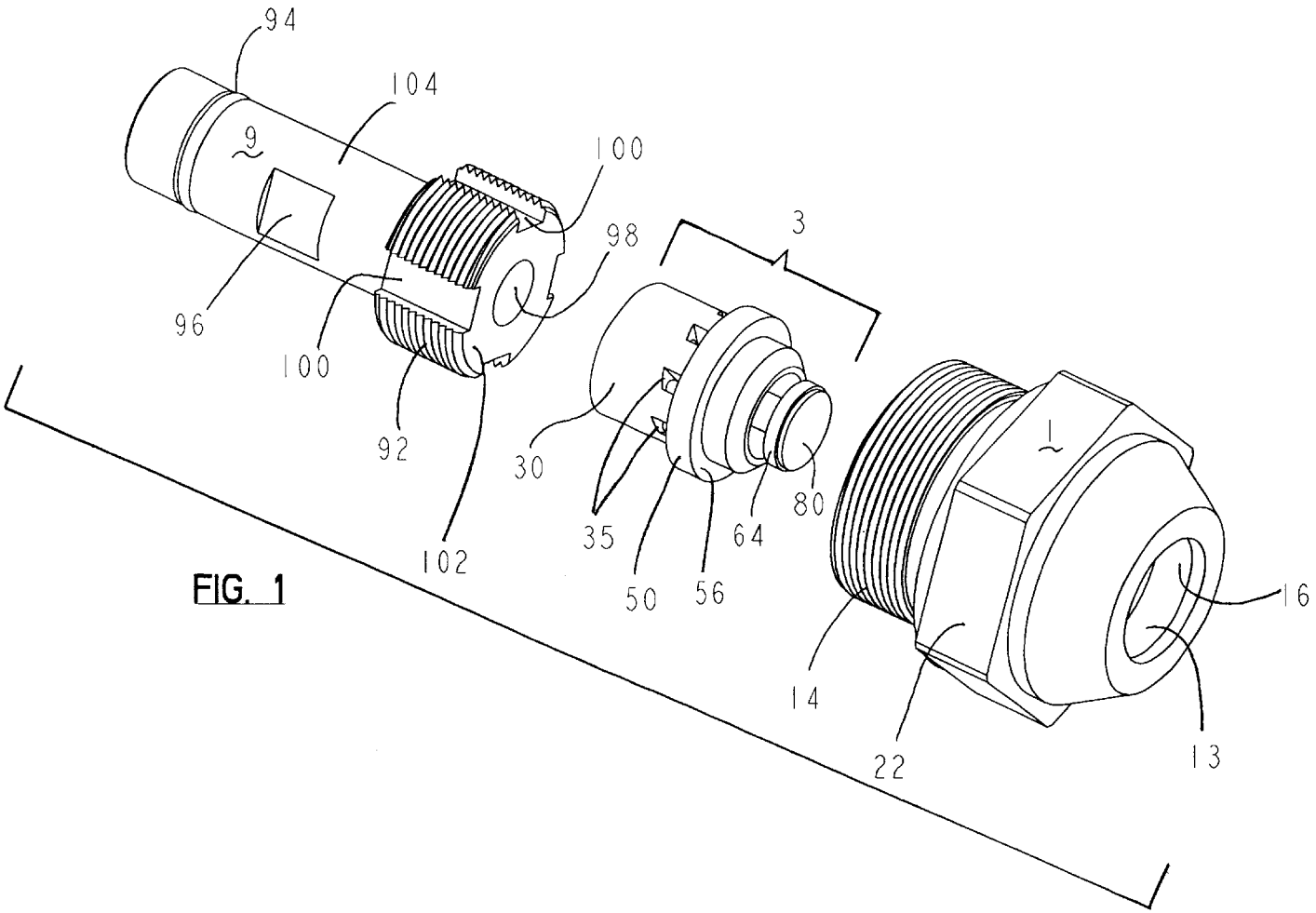
FIG. 1 is an exploded view of a preferred embodiment of dual-fluid nozzle with self-cleaning pintle system constructed to operate in accordance with the principle of the current invention.

A preferred embodiment of a nozzle, shown in FIG. 1, constructed to operate in accordance with the principles of this invention comprises a vortex-mixing-module 3, a module adapter 1, and a holder 9.

Figure 2:
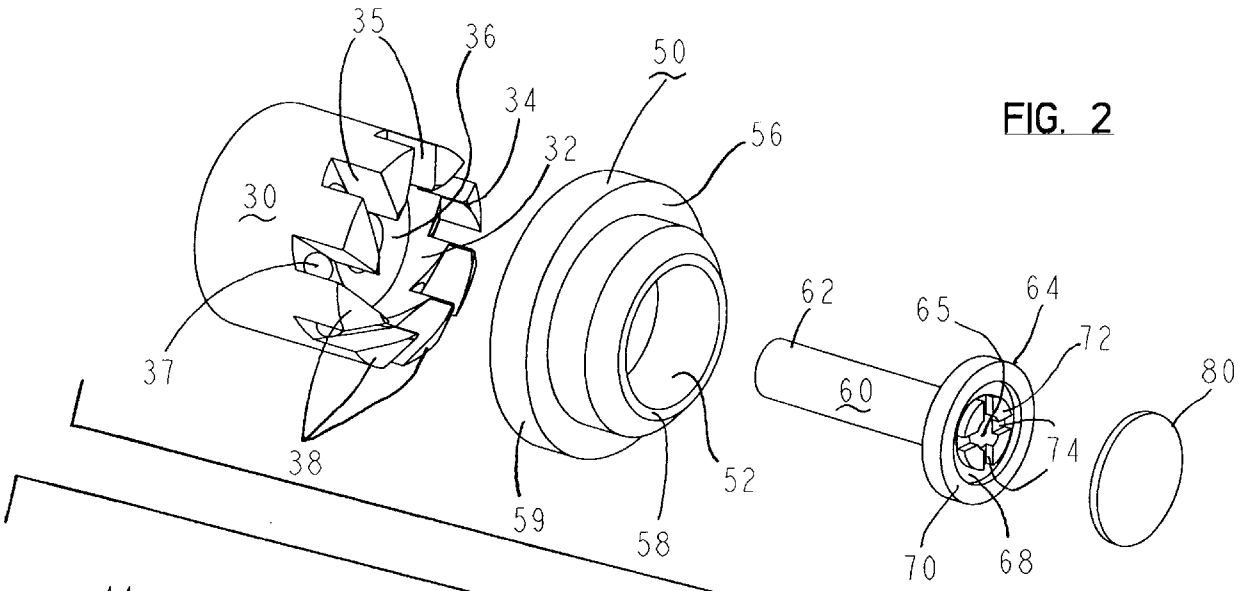
FIG. 2 is a front-perspective-exploded view of a preferred embodiment of the vortex-mixing-module 3 shown in FIG. 1.
Figure 3:
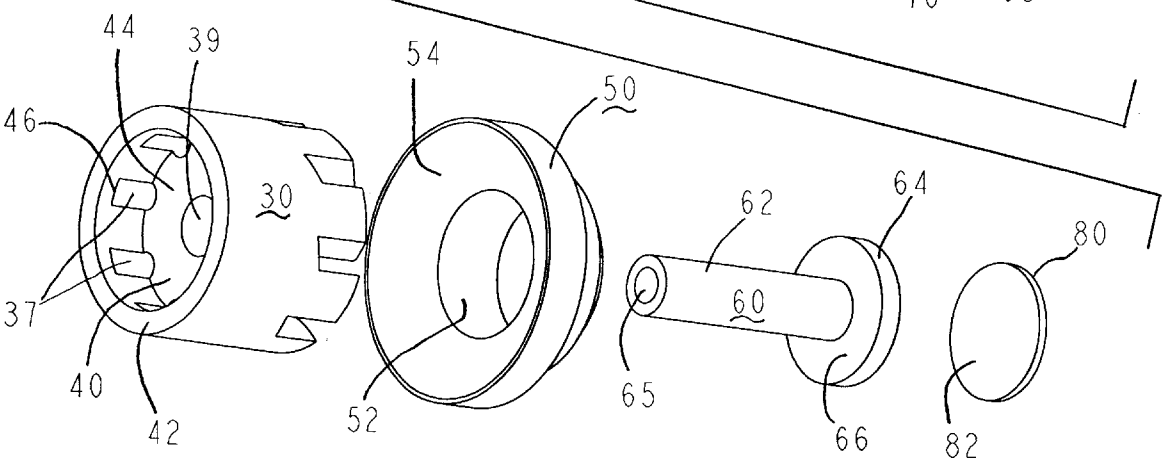
FIG. 3 is a rear-perspective-exploded view of a preferred embodiment of the vortex-mixing-module 3 shown in FIG. 1.

The Vortex-mixing-module 3 (FIGS. 2,3,4) comprises a swirler housing 30, an orifice body 50, a pintle body 60 and a disk 80. The swirler housing 30 is substantially a cylindrical body on which a mixing chamber 32 is bored from the surface 34 to the surface 36. On the end of surface 34 a conical convex-surface 38 is also formulated with an included angle, such as lying in the range of 90 to 150 degrees, to provide a self-aligned surface contact during the assembly with the mating surface of the orifice body 50. On the other end of the swirler housing 30, FIG. 3, a buffer chamber 40 is bored from the surface 42 to the surface 44. Several equally spaced slots 35 are prepared, such as milled, on the cylindrical wall the of the mixing chamber side to provide communication conduits from the exterior of the housing to the mixing chamber 32. These slots are substantially tangentially prepared on the wall, so that as the liquid from the exterior of the body is guided into the chamber 32 through these slots, a swirling vortex flow will be induced. In each slot, a hole 37 is also prepared, such as drilled, in parallel with the cylindrical axis of the swirler housing from the bottom of the slot through the ceiling, defined by the surface 36 and 44 of the swirler body, and up to a predetermined height of surface 46 on the wall of the buffer chamber 40. As shown in FIGS. 2, 3, the hole 37, of diameter no larger than the width of the slot, are positioned in the slot and with its edge very close to the edge of the mixing chamber. The gas holes 37, now looking from the buffer chamber side, are partially drilled into the wall of the buffer chamber and up to the height of surface 46. The distance of surface 46 to surface 44 is predetermined to assure that the flow passage opening from the chamber 40 to hole 37 is larger than the cross-section area of the hole 37 itself. This arrangement is to use the exposed/interfered portion of hole 37 in the buffer chamber as a leading entrance to lead the gas through the hole into the slots of liquid to initiate mixing followed by generating a swirling vortex as the mixed fluid is entering the mixing chamber. In some other conditions, when the mixing chamber is designed to be smaller than the current layout shown or when the gas hole 37 is drilled at a slant angle (not shown) relative to the axis of the housing 30, the holes 37 may not interfere with the wall of the buffer chamber and will end on the ceiling only, surface 44. In these scenarios, the function of the mixing module will be identical as far as the spirit of this invention is concerned. This arrangement will provide the benefits of double-dipped liquid/gas mixing efficiency with very compact swirler geometry by allowing both fluids to pass through the same tangentially cut slots.

Figure 4:
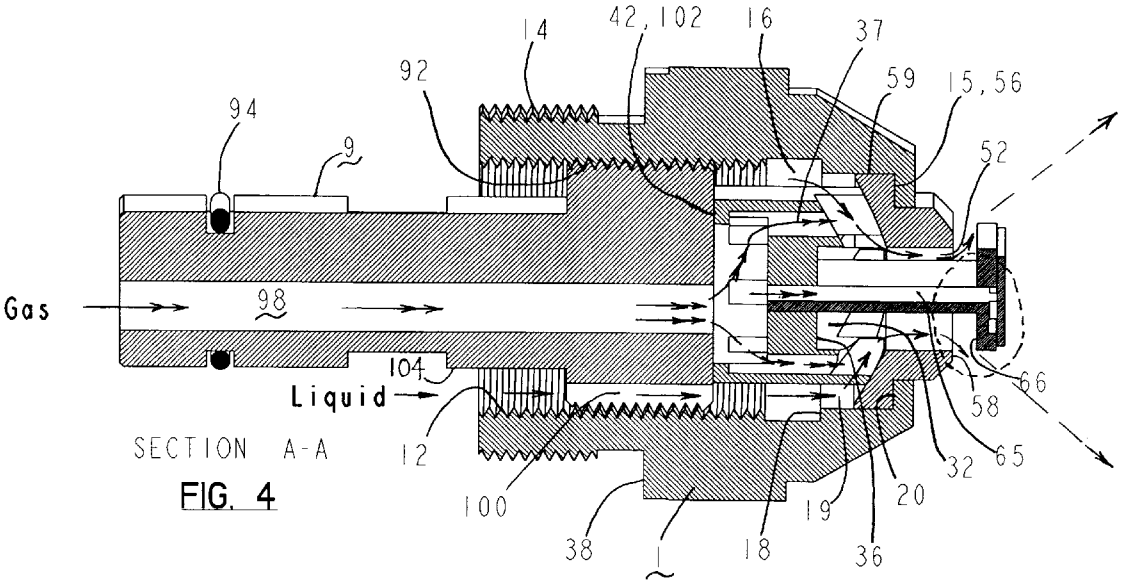
FIG. 4 is a cross section view of a preferred embodiment of dual-fluid nozzle with self-cleaning pintle system constructed to operate in accordance with the principle of the current invention shown in FIG. 1.

In FIGS. 2 and 3, a cylindrical-shape orifice body 50 is made with a center-bored through-hole 52, with a size no larger than the internal diameter of the mixing chamber 32. The upstream surface 54 of the orifice body is a conical-concave shape with the same included angle as the surface 38 of the swirler housing 30, such as lying between 90 to 150 degrees, in order to properly seal each other during the assembly. On the opposite side of the surface 54, a flange surface 56, substantially vertical to the axis of the body, is prepared for liquid sealing purpose when the vortex swirler module 3 is assembled to the nozzle adapter 1 (FIGS. 1, 4). The flange outer diameter, surface 59, is sized for close clearance with the mating part of adapter 1 for alignment purposes in the nozzle assembly. In one possible embodiment sharing the same spirit of this invention, the through hole 52 of the orifice body is constructed in the shape of a Venturi (as the orifice surface 210 in FIG. 7), i.e., the internal diameter of the wall is progressively decreased along the passage of the orifice to a minimum dimension then gradually increased back. This embodiment is applied to the cases when the quantity of atomization gas is relatively low in supply and the uniformity of the mixed fluid will be determined mainly by the distribution of liquid flow; then the convergent and divergent passage design, Venturi, can maximize their distribution pattern.

Figure 6:
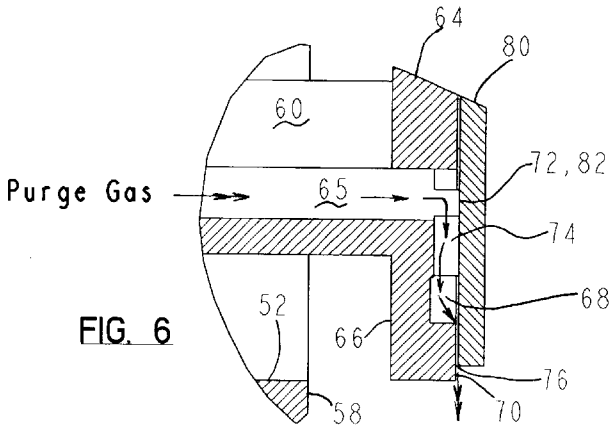
FIG. 6 is an enlarged partial cross section view of the purging gas outlet shown in the dotted zone in FIG. 4.
Figure 5:
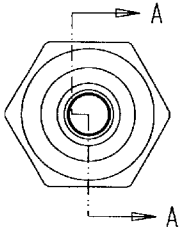
Figure 8:
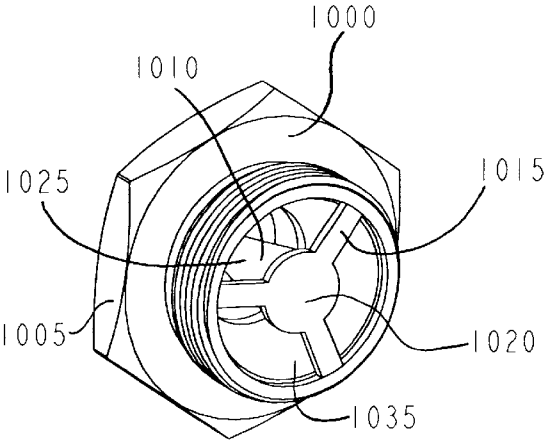
FIG. 8 (PRIOR ART)
FIG. 8 is a rear perspective view of a prior art nozzle cap.
Figure 10:
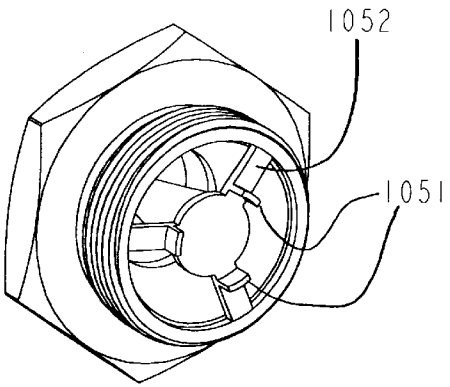
FIG. 10 (PRIOR ART)
FIG. 10 is a rear perspective view of another prior art nozzle cap.

In FIGS. 2 and 3, a pintle body 60 comprising a substantially cylindrical stem 62 and a deflector head 64 of substantially disk-shape with a center hole 65 drilled through is shown. On the deflector head 64, the upstream surface 66 is substantially vertical to the pintle axis with an outer diameter, head 64, slightly smaller than the smallest diameter of orifice 52. This arrangement is for accessibility while assembling the entire swirler-vortex module together. On the downstream side of the deflector head, an annular groove 68 is prepared concentrically on the surface to divide the remaining surface into two annular surfaces 70 and 72. The annular surface 70 is machined to be lower than the annular surface 72 at a predetermined quantity. Multiple slots 74 are cut (FIG. 2), 4 slots as shown, on the annular surface 72 at a predetermined depth to provide the radial-conduits between the center hole 65 and the annular groove 68. Finally, the surface 82 of the disk 80, with no larger diameter than the diameter of the deflector head 64, is sealed, such as welded, to the surface 72 substantially concentrically. With this arrangement, a gap 76, FIG. 6, is formed between the annular surface 70 on the deflector head and the surface 82 of the disk 80. On the assembly of pintle body 60 and disk 80, in detail, a gas conduit is formulated which comprises the gas passages of hole 65, slots 74, annular groove 68 and annular gap 76. This assembly is then coupled to the center-drilled hole 39 on the ceiling of the housing 30 at a predetermined axial location along the stem 62 of pintle body 60. This forms a predetermined gap between the exiting edge 58 of the orifice body 50 and the deflector head surface 66 when they are assembled together. This predetermined gap is the nozzle metering passage, which serves to define the flow capacity for both gas and liquid as well as shape the spray angles. The methods of coupling the pintle body 60 and the housing 30 can be by welding or by other ways such as threading, which is not shown in the drawing.

The holder 9 (FIGS. 1, 4) is made from a bar of drumstick shape with external threads 92 on one end and o-ring seal 94 the other. A center hole 98 is drilled-through on the holder. The o-ring seal 94 is to connect an external conduit for guiding gas into the nozzle through the center hole 98. In some other applications, within the scope of the spirit of this invention, the o-ring seal can be replaced by either internal or external thread (not shown) for the connecting purpose. Two parallel-flat-surfaces 96 are prepared on the exterior surface 104 of the holder 9 for torque purposes during assembly. Several equally spaced slots 100 are cut axially through the thread 92 at a predetermined width and depth to provide liquid conduits for the assembled nozzle when it is in operation.

The adapter 1 (FIGS. 1, 4), with both external threads 14 and internal threads 12, is to host the vortex-mixing-module 3 and the holder 9. At the downstream of the internal thread 12, an annular groove 16 is bored to clear the thread 12 up to the surface 18 and a tight clearance hole 19 is also bored concentrically between surface 18 and surface 20 to fit with the flange diameter 59 of the orifice body 50. As the vortex-mixing-module 3 is placed into the adapter 1 (FIGS. 1, 4), the flange surface 56 of the orifice body 50 will be bottomed-to and seal on the surface 15 of the adapter 1. In the meantime, the swirler housing 30, integrated with the pintle body 60 and purge disk 80, is pressed from the back surface 42 of the body by the surface 102 of the holder 9. Through the action of pressure force from the holder 9, both the swirler housing 30 and the orifice body 50 will be closely-contacted and concentrically-aligned due to the conical mating surface provided on both parts. The same force also causes a tight seal between surface 56 of the orifice body 50 and surface 15 of the adapter 1.

One possible embodiment which shares the same spirit of this invention makes use of the orifice body 50 combined with the adapter 1 as an integrated part (not shown). In this case, the features on the orifice body 50 such as conical surface 54 and the through hole 52 are part of the adapter 1. This arrangement is a very easy practice which can benefit from a reduced total number counts of the parts of this invention, but will limit the material variation capability between the adapter and the orifice. Sometimes the capability of material selection between the orifice body 50 and the adapter 1, as the main embodiment shown, can be vital to the success of certain nozzle applications.

Figure 7:
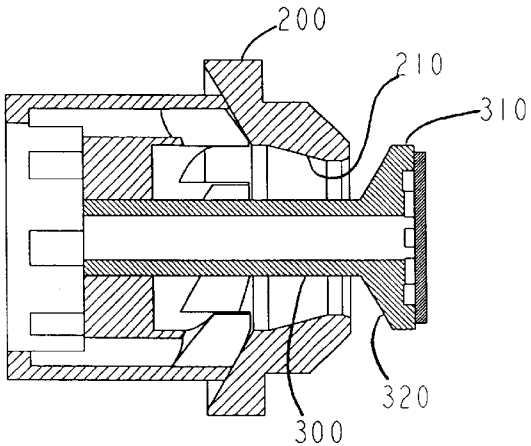
FIG. 7 is a cross section view of another embodiment of vortex-mixing-module assembly sharing the same spirit of the current invention combined with a converging-diverging (Venturi) orifice geometry coupling to a conical shape deflector head.
Figure 9:
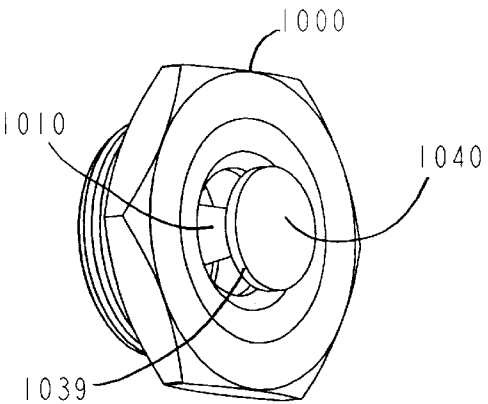
FIG. 9 (PRIOR ART)
FIG. 9 is a front perspective view of a prior art nozzle cap.

Another possible embodiment, shown in FIG. 7, which shares the same spirit of this invention, is that the through hole 210 of the orifice body 200 is made into a convergent-divergent passage, Venturi type. This modification focuses the mixed fluid into a more confined cross-section area before exiting to the injector, making the spray distribution more uniform when the atomization gas consumption rate is limited.

Another possible embodiment, shown in FIG. 7, which share the same spirit of this invention, is that the upstream surface 320 of the deflector head 310 on the pintle stem 300 is a conical shape. This modification provides alternative ways to shape the spray angle by the angle of the cone of the deflector head.

After the detailed description of all the parts of this invention, it is believed that the spirit and advantage of the design can be presented more clearly by describing the function of the complete assembly shown in FIGS. 1 and 4. In this illustration, the vortex-mixing-module 3 is placed in the adapter 1 where the flange 56 of the orifice body 50 is to be bottomed at the surface 15 of the adapter 1. The holder 9 is screwed into the internal thread 12 of the adapter 1 and seals on the surface 42 of the housing 30 with the surface 102. By doing so, the flange 56 of the orifice body 50 will also be sealed by the surface 15 of the adapter 1. During the nozzle operation, a liquid from an upstream source (not shown) is pumped to the conduits set between the thread 12 of the adapter and the exterior surface 104 of the holder 9. It is then guided through the slots 100 on the holder 9 and goes between the threads 12 and the exterior surface of the housing 30 into the annular chamber defined by the groove 16 in the adapter 1 and the exterior surface of swirler housing 30. The liquid will then be injected into the tangential cut slots 35 of the swirler housing.

Meanwhile, a pressurized gas from the gas source (not shown) is conducted to the holder 9, through the center hole 98 of the holder, to the baffle chamber 40 of swirler housing 30. The majority of the gas, serving as atomization gas, is guided into the holes 37 on the ceiling of the housing 30 and impinges onto the liquid flowing through slots 35. The pre-mixed liquid/gas fluid in the slots is then injected into the mixing chamber 32 forming vortex flows. During this process, numerous tiny gas bubbles are formed and entrapped in the fluid. The mixed fluid, bubble-laden-fluid, then moves from the mixing chamber through the annular passage defined by the hole 52 of the orifice body 50 and the exterior surface of stem 62 of the pintle 60, and flows down to the metering section of the vortex-mixing-module defined by the distance between edge 58 of the orifice body 50 and the surface 66 of the deflector head 64. As the bubble-laden-fluid is passing through the metering section of the module, the sudden expansion of gas bubbles in the fluid, induced by pressure reduction, will accelerate its velocity and break the liquid into fine drops. The high velocity drops in this stream then encounter a secondary atomization caused by the ambient turbulence-induced flow-field. A predetermined portion of gas, called purge gas, in the baffle chamber 40 of the swirler housing 30 is, in the meantime, guided as in FIG. 6 through the center hole 65 of the pintle body 60, the slots 74, the annulus groove 68 on the deflector head 64, and the gap 76, thoroughly cleaning the edge of the downstream surface 70 of the deflector head 64.

Looking through the description of the spirit and function related to the preferred embodiment of current invention, it has been found that the nozzle performance and its operation life span are greatly improved for the following reasons. First, the introduction of ducting both fuel and gas into the same tangentially cut slots on the mixing module not only enhances the mixedness of those two fluids with a more compact swirler design but also improves the turn-down ratio of the nozzle due to a more stable aerodynamic vortex flow forming at low flow rate conditions. Second, by introducing the pintle stem with gas-purging means directly to the ceiling of the housing 30 in this invention, both the potential of erosion-induced nozzle damage to the pintle spokes and the compromised spray quality by hard-coking layer on the pintle surface experienced in the prior arts are totally eliminated. It should also be noted that the shortcomings of nonsymmetrical spray distribution with compromised angular momentum of the spray caused by the spokes in the mixing chamber of prior arts are much improved as well.

It should be understood that the preferred embodiment and some possible embodiments described above sharing the same spirit of the present invention are merely illustrative of some of the applications of the principles of the invention. Numerous modifications may also be made by those skilled in the art without departing from the true spirit and scope of the invention.

What is claimed is:

1. A nozzle for atomizing a liquid, comprising:

a mixing means comprising a mixing chamber with a downstream opening;

first-fluid inlet means, a first-fluid flowing through, communicating substantially tangentially to said mixing chamber and setting up a vortex flow as said first-fluid flows in;

second-fluid inlet means, a second-fluid flowing through, communicating substantially axially to said first-fluid inlet means, allowing said first-fluid to mix with said second-fluid in said first-fluid inlet means forming a mixed-fluid, while setting up said vortex flow as said mixed-fluid flows into said mixing chamber;

an orifice body coupled to said mixing means at the downstream having a discharge opening for discharging said mixed-fluid out of said nozzle;

a deflecting means, coupled to said mixing means, comprising a substantially cylindrical stem and a substantially disk shape deflector head which includes an upstream surface for impingement of said mixed-fluid and a downstream surface coupled with a gas-purging means, fitted with a gas passage comprising a center conduit on said stem, at least one slot-communicating means connecting said stem to an annular groove on said deflector head and a gap set between said downstream surface of said deflector head and surface of said gas-purging means;

a metering means, a predetermined passage gap, formed between said upstream surface of said deflector head and the exiting edge of said discharge opening of said orifice body while coupling said mixing means, said deflecting means and said orifice body together; and a locking means for coupling said mixing means and said orifice body.

2. The nozzle of claim 1, wherein said first-fluid introduced by said first-fluid inlet means is a liquid, and said second-fluid introduced by said second-fluid inlet means is a gas.

3. The nozzle of claim 1, wherein said locking means used between said mixing means and said orifice body is with conical surfaces on both said mixing means and said orifice body, which provides self-aligning capability between these two when they are assembled.

4. The nozzle of claim 1, wherein said locking means used between said mixing means and said orifice body is with flat surfaces on both said mixing means and said orifice body.

5. The nozzle of claim 1, wherein said first-fluid inlet means is a plurality of substantially tangentially cut slots which are also vertical to the axis of said mixing means.

6. The nozzle of claim 5, wherein said tangentially cut slots have a compound angle which is also substantially parallel to said conical surface of said mixing means.

7. The nozzle of claim 1, wherein said first-fluid inlet means is a plurality of substantially tangentially drilled holes and said second-fluid inlet means is a plurality of substantially axially drilled holes which intersect with said first-fluid inlet means.

8. The nozzle of claim 1, wherein said discharge opening on said orifice body has a diameter of no larger than the diameter of said downstream opening of said mixing chamber on said mixing means.

9. The nozzle of claim 1, wherein the internal side wall at the exiting port of said discharge opening of said orifice body has a profile of Venturi shape which is progressively decreased in diameter along the passage of said discharge opening to a minimum dimension then gradually increased back.

10. The nozzle of claim 1, wherein said upstream surface of said deflector head of said deflecting means has a conical shape for spray angle formation.

11. The nozzle of claim 1, wherein said locking means comprising an adapter and a holder.

12. A nozzle for atomizing a liquid, comprising:

a mixing means comprising a mixing chamber with a downstream opening;

first-fluid inlet means including a first-fluid flowing through, communicating substantially tangentially to said mixing chamber and setting up a vortex flow as said first-fluid flows in;

second-fluid inlet means including a second-fluid flowing through, communicating substantially axially to said first-fluid inlet means, allowing said first-fluid to mix with said second-fluid in said first-fluid inlet means forming a mixed-fluid, while setting up said vortex flow as said mixed-fluid flows into said mixing chamber;

an orifice body coupled to said mixing means at the downstream having a discharge opening for discharging said mixed-fluid out of said nozzle;

a deflecting means, coupled to said mixing means, comprising a substantially cylindrical stem and a substantially disk shape deflector head which includes an upstream surface for impingement of said mixed-fluid;

a metering means, a predetermined passage gap, formed between said upstream surface of said deflector head and the exiting edge of said discharge opening of said orifice body while coupling said mixing means, said deflecting means and said orifice body together; and a locking means for coupling said mixing means and said orifice body, including substantially conical surfaces on both said mixing means and said orifice body, which provides self-aligning capability between these two when they are assembled.

13. The nozzle of claim 12, wherein said discharge opening on said orifice body has a diameter of no larger than the diameter of said downstream opening of said mixing chamber on said mixing means.

14. The nozzle of claim 12, wherein the internal side wall at the exiting port of said discharge opening of said orifice body has a profile of Venturi shape which is progressively decreased in diameter along the passage of said discharge opening to a minimum dimension then gradually increased back.

15. The nozzle of claim 12, wherein said first-fluid inlet means is a plurality of substantially tangentially cut slots which are also vertical to the axis of said mixing means.

16. The nozzle of claim 15, wherein said tangentially cut slots have a compound angle which is also substantially parallel to said conical surface of said mixing means.

17. The nozzle of claim 12, wherein said upstream surface of said deflector head of said deflecting means has a conical shape for spray angle formation.

* * * * *